US009803907B2

(12) United States Patent
Erbs et al.

(10) Patent No.: US 9,803,907 B2
(45) Date of Patent: Oct. 31, 2017

(54) METHODS AND SYSTEMS FOR IMPROVING AND MAINTAINING THE CLEANLINESS OF ICE MACHINES

(75) Inventors: Daryl G. Erbs, Sheboygan, WI (US); William E. Smith, Jr., Sheboygan, WI (US); William E. Olson, Jr., Bellevue, WI (US); Janice M. K. Jaferian, Palm Harbor, FL (US)

(73) Assignee: MANITOWOC FOODSERVICE COMPANIES, LLC, Manitowoc, WI (US)

( * ) Notice: Subject to any disclaimer, the term of this patent is extended or adjusted under 35 U.S.C. 154(b) by 0 days.

(21) Appl. No.: 13/369,833

(22) Filed: Feb. 9, 2012

(65) Prior Publication Data

US 2012/0198870 A1 Aug. 9, 2012

(51) Int. Cl.
*F25C 1/00* (2006.01)
*F25C 1/12* (2006.01)

(52) U.S. Cl.
CPC ..... *F25C 1/12* (2013.01); *F25C 2400/12* (2013.01)

(58) Field of Classification Search
CPC .... F25C 1/12; F25C 2400/12; F25C 2400/14; F25C 1/00
USPC ..... 62/347, 66, 67, 317, 318, 74, 78, 180, 62/303; 250/435; 96/224
See application file for complete search history.

(56) References Cited

U.S. PATENT DOCUMENTS 4,550,572 A 11/1985 Schulze-Berge
4,878,361 A 11/1989 Kohl et al.
4,907,422 A 3/1990 Kohl et al.
5,586,439 A * 12/1996 Schlosser et al. ..... 62/78
5,752,393 A 5/1998 Schlosser et al.
5,908,494 A * 6/1999 Ross et al. ..... 96/356
6,093,312 A * 7/2000 Boulter ..... 210/86
6,334,328 B1 * 1/2002 Brill ..... 62/347
6,681,580 B2 1/2004 Shedivy et al.
7,156,895 B2 1/2007 Rubin et al.
7,832,219 B2 11/2010 Baranowski et al.
2003/0046942 A1 * 3/2003 Shedivy et al. ..... 62/71
2003/0080068 A1 * 5/2003 Koslow ..... A47L 15/42 210/748.12
2005/0145108 A1 * 7/2005 Rubin et al. ..... 95/226
2006/0026985 A1 2/2006 Hollen et al.
(Continued)

FOREIGN PATENT DOCUMENTS

CN 1180321 A 4/1998
CN 2572310 9/2003
(Continued)

OTHER PUBLICATIONS

International Preliminary Report on Patentability dated Feb. 7, 2013 corresponding to International Patent Application No. PCT/US2012/024467.
(Continued)

*Primary Examiner* — Len Tran
*Assistant Examiner* — Ana Vazquez
(74) *Attorney, Agent, or Firm* — Ohlandt, Greeley, Ruggiero & Perle, LLP

(57) ABSTRACT

The use of the following techniques to clean air: (1) inlet air filtration, (2) continuous recirculation air filtration, (3) water filtration and disinfection, (4) use of an air curtain in the ice bin opening, and (5) provision of clean air to the air assist pump during the harvest cycle.

12 Claims, 10 Drawing Sheets

(56) References Cited

U.S. PATENT DOCUMENTS

| | | | | |
|---|---|---|---|---|
| 2007/0089451 | A1* | 4/2007 | Lee | 62/352 |
| 2007/0130983 | A1* | 6/2007 | Broadbent et al. | 62/351 |
| 2007/0196244 | A1* | 8/2007 | Croft | 422/121 |
| 2008/0271475 | A1* | 11/2008 | Wuesthoff | F25D 17/065 62/447 |
| 2009/0000320 | A1* | 1/2009 | Walton et al. | 62/137 |
| 2009/0023376 | A1* | 1/2009 | Miller | B01D 46/0024 454/230 |
| 2009/0142225 | A1* | 6/2009 | Tornqvist | A23G 9/30 422/28 |
| 2009/0236368 | A1* | 9/2009 | Coon | C12H 1/22 222/152 |
| 2010/0322442 | A1* | 12/2010 | Namm | H04R 1/08 381/122 |
| 2012/0048115 | A1* | 3/2012 | Crabtree et al. | 95/273 |

FOREIGN PATENT DOCUMENTS

| | | | |
|---|---|---|---|
| JP | S61186772 | A | 8/1986 |
| JP | H63134364 | U | 9/1988 |
| JP | 10238917 | | 9/1998 |
| JP | 10238917 | | 11/1998 |
| JP | 11506049 | | 6/1999 |
| JP | 2004340411 | | 12/2004 |
| JP | 2006118848 | | 5/2006 |
| JP | 2009011557 | | 1/2009 |
| JP | 2006166747 | A | 6/2009 |
| JP | 2009142182 | | 7/2009 |
| JP | 2011019647 | | 2/2011 |
| WO | 2007100537 | A2 | 9/2007 |
| WO | 2012106484 | A2 | 8/2012 |

OTHER PUBLICATIONS

International Search Report and Written Opinion dated May 23, 2012 in the Corresponding PCT/US2012/24467.

Search History, Dated May 10, 2012 in Corresponding PCT/US2012/24467.

Japanese Office Action dated Jun. 2, 2015 for Japanese application No. 2013-553561.

Japanese Office Action dated Sep. 2, 2014 for Japanese application No. 2013-553561.

Chinese Office Action (English translation) dated Jan. 19, 2015 for Chinese patent application No. 2012800163629.

Japanese Office Action dated Jun. 14, 2016 for Japanese application No. 2015-170092.

* cited by examiner

FIG. 1A
Prior Art
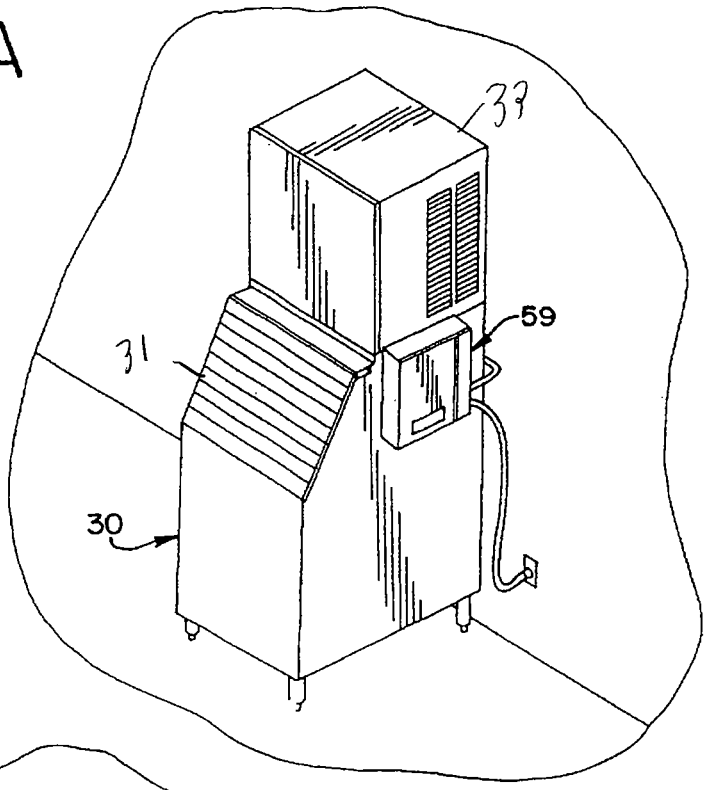
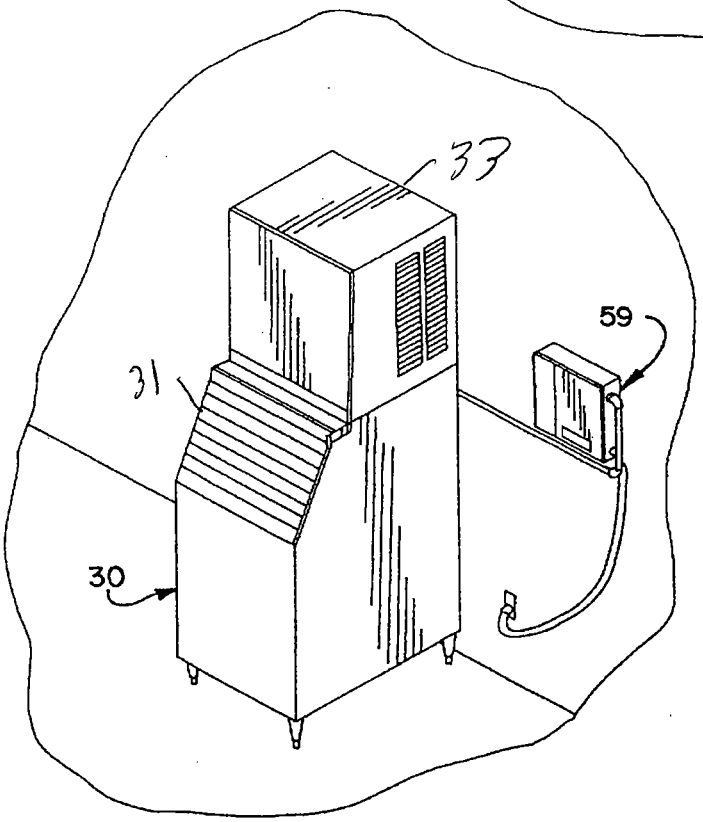
FIG. 1B
Prior Art

METHODS AND SYSTEMS FOR IMPROVING AND MAINTAINING THE CLEANLINESS OF ICE MACHINES

CROSS-REFERENCE TO RELATED APPLICATIONS

This application claims the benefit of U.S. Provisional Application No. 61/441,213, filed Feb. 9, 2011. U.S. Provisional Application No. 61/441,213, filed Feb. 9, 2011 is hereby incorporated by reference in its entirety.

BACKGROUND

1. Field

The present disclosure generally relates to methods and system for cleaning the air that enters into or is used during the ice making process. In particular, the present disclosure uses of the following techniques to clean air: (1) inlet air filtration, (2) recirculation air filtration, (3) water filtration and disinfection, (4) use of an air curtain in the ice bin opening, and (5) provision of clean air to the air assist pump during the harvest cycle.

2. Discussion of the Background Art

The cleanliness of ice machines has been a challenge to ice machine manufacturers for years. The primary method is periodic sanitizing of food contact surfaces in the machine with a sanitizing agent. This is also sometimes augmented with the treatment of surfaces and components with known anti-microbials, such as a silver ion coating of surfaces. While this method is effective in controlling organism growth on the ice bin surfaces, it does not address the ingress of organisms into the ice making compartment.

One conventional means for sterilizing and cleaning ice making machines is shown in FIGS. 1A and 1B which illustrate two separate embodiments for external location of an add-on self-cleaning system 59. The automatic self-cleaning system 59 may also be built internal to the ice machine 30.

The Coolant/Refrigerant System

An embodiment of the automatic ice making system's coolant/refrigerant system is illustrated in FIG. 2.

In FIG. 2, the coolant/refrigerant system comprises a condenser 11, an evaporator 12 and a compressor 14. FIG. 2 illustrates a refrigerant supply line 20, a drier for the refrigerant 21, and an expansion device 13. The expansion device serves to lower the pressure of the liquid refrigerant.

When the compressor 14 is operating, high temperature, high pressure vaporous refrigerant is forced along a discharge line 26 back to the condenser 11. When the ice making system goes into its harvest cycle, a normally closed hot gas solenoid valve 40 opens and hot vaporous refrigerant is fed through line 15 into the evaporator 12.

Further details of the operation of this system can be gleaned from careful review of U.S. Pat. No. 4,878,361 and U.S. Pat. No. 4,907,422, which are incorporated herein in there entireties by reference thereto.

This coolant/refrigerant system in contact with the evaporator 12 also preferably contains a control circuit which causes the refrigeration system to cool down the ice mold to well below freezing at the start of the ice making cycle. This improvement is described in U.S. Pat. No. 4,550,572, which is incorporated herein in its entirety by reference thereto.

As a result, the ice-forming mold or evaporator plate in contact with the evaporator 12 is cooled well below freezing prior to the water pump in the water/ice system being energized to deliver water to the ice-forming mold.

The Water/Ice System

The water/ice system normally comprises a water supply or water source, a water reservoir or sump, drain valves from the sump to a line draining to the drain or sewer, water circulation mechanism, water distribution means, and appropriate connecting lines. Water is distributed across an ice-forming mold, or evaporator plate, and forms ice thereon. Unfrozen water flows down the plate onto a water curtain and is returned to the water sump. When ice has been formed as required, it is harvested and falls into the ice bin.

FIGS. 3A and 3B illustrate schematically the water/ice system, but does not show the ice collector bin or reservoir. In FIGS. 3A and 3B, a water supply 1 provides source water, normally tap water or tap water which has optionally been treated by filtration, ion exchange or the like to improve its quality. Attached lines control and direct the flow of water from the water supply to flow into the water sump 3. The sump is equipped with a level controller 2, a solenoid dump valve 9, a drain line 10, and is connected and supplies a water supply to the suction side of the circulating pump 4. Pump 4 circulates water from sump 3 to the distributor 7, where the water is directed over the evaporator plate 6 (also called the ice-forming mold or ice tray).

The water from the distributor 7 is directed across the evaporator plate 6 and, if not frozen to form ice on a first pass, is collected by the water curtain 5. This collected water is allowed to flow down the water curtain into the water sump or water reservoir 3, where it is collected and again circulated by the circulating pump 4 to the distributor 7 and recycled across the ice tray during the freezing cycle.

Once the ice forming on the evaporator plate 6 has reached a certain thickness, the water flowing over the surface of that frozen ice product reaches contact with the ice thickness probe 8, which signals the controller to stop the freeze cycle. The ice thickness probe can be varied in its distance from the planar surface of the evaporator plate so as to provide ice having a bridge thickness of from about 1/16 inch to about 1/4 inch, preferably about 1/8 inch. This begins the harvest cycle.

In the harvest cycle, the coolant no longer is pumped through the evaporator. Instead, the hot gas solenoid valve 40 is opened and operated according to FIG. 2 and the teachings of the patents cited and incorporated above to route hot vaporous refrigerant from the compressor 14 to the evaporator 12 through a discharge line 26 and bypass line 15, thereby heating up the evaporator plate. This causes the ice to release from the evaporator plate and fall against the water curtain and into the ice collection reservoir.

As can be seen, when the ice falls away from the evaporator plate structure, it must fall against the water curtain which is hinged. The water curtain is pushed away from the evaporator plate, thereby opening an electrical contact on the water curtain and allowing the ice to fall into the ice bin. The water sump, evaporator plate and water curtain are placed in such a way that the ice must fall against the water curtain and into the bin and cannot fall into the water sump or water reservoir. Similarly, water flowing down the curtain is directed away from the ice bin and into the water sump when the curtain is not displaced by the harvested ice.

After the ice falls into the bin, the water curtain springs or swings back into its original position, again making contact with the electrode placed thereon and sending a signal indicating that the harvest cycle is complete and that a new freeze cycle may begin.

On re-initiation of the freeze cycle, refrigerant/coolant is again pumped from the compressor through the refrigerant/ coolant system to the evaporator to pre-cool the evaporator for the period of time mentioned above, the hot gas solenoid valve is shut, and the water system begins its next cycle.

Periodically the solenoid drain valve 9 may be activated to drain the water in the water sump, which water has a tendency to build up concentration of water hardness chemicals, such as calcium salts and magnesium salts. Pure water freezes at higher temperatures than does water containing these, or other, dissolved salts. Also, water that contains higher levels of salts freezes at lower temperature and forms what the art terms "white ice." Fresh water can be then recharged to the water/ice system, which inhibits the formation of white ice. When the solenoid valve is activated to the open position, the water sump is drained, the solenoid is then closed (normally after a preset time has passed), and the fresh water recharges the system. Normally this fresh water recharging and recycled water discharge occur when the ice thickness probe indicates ice build up and the harvest cycle is initiated. This stops the coolant circulation and the water circulation.

In spite of the precautions mentioned above, the circulating water can lead to the build up of certain deposits on metal surfaces in the water/ice system. Particularly prone to build up of these deposits are the surfaces of the water sump, the internal surfaces of connecting lines from the sump to the circulating pump and through the circulating pump to the distributor, the distributor itself, and particularly the evaporator plate or ice molding surfaces or fins designed in the ice-forming trays made a part of the evaporator plate and in close proximity or attached directly to the evaporator external surfaces.

When these deposits form, they inhibit water flow, increase corrosion of the metal surfaces, inhibit heat transfer efficiencies, and generally cause poor operation of the ice maker, which, in turn, can lead to poor ice formation and in some cases bad tasting or bad looking ice (white ice).

Cleaning/Sterilizing System

The cleaning/sterilizing system can minimally include control and monitoring capabilities permitting manual or automatic shutdown of the coolant/refrigerant system followed by emptying the water accumulated in the water/ice system by opening the drain valve 9 for a time sufficient to empty the water to the drain. After this time has passed, the solenoid drain valve 9 automatically closes, fresh water from supply 1 is added to the system, and water pump 4 begins circulation. Fresh water is circulated for a prescribed period of time, as programmed into the controller and the pump is turned off, the drain valve 9 is opened, and the cleaning water evacuated to the drain 10. The procedure is repeated at least 3 times, preferably from 4-6 times. If desired, a cleaning solution may be added manually to the first rinse water when machines of this invention are operating without the add-on cleaning/sterilizing system 59 of FIGS. 1, 4 and 5.

The preferred self-cleaning system which is contained in or can be connected to the automatic ice machine 30 described above comprises at least one cleaning/sterilizing solution reservoir, at least one injection device servicing the reservoir, interconnecting feed lines from the reservoirs to the suction side of this injection mechanism, optional check valves or solenoid valves installed between the injection mechanism and the water system, and an injection line connector into the circulation water lines, or alternatively directly into the water reservoir or sump of the water/ice system. The cleaning/sterilizing injection line then feeds either or both the cleaning solution and sterilizing solution into the water/ice circulating system liquid. This line operates to feed the cleaning solution, or can operate to feed the sterilizing solution, or may operate to feed both cleaning and sterilizing solutions, in any sequence, or simultaneously.

FIGS. 4 and 5 provide information regarding the cleaning solution/sterilizing solution storage vessels or containers, connecting lines, injection mechanism or devices, check valves, the cleaning/sterilizing injection lines, the electronic control panels, and the like.

In FIG. 4A, which is an inside view of the add-on box 59 of FIG. 1A, a vinyl tube 50 is supplied to reach nearly to the bottom of a storage bottle or vessel 51. This vessel 51 can contain cleaning solution or sterilizing solution 52 or both if appropriate. The invention may operate with a single bottle or storage vessel with cleaning solution, a single storage vessel with sterilizing solution, or with multiple storage vessels and injection mechanisms for both cleaning and sterilizing solutions. Preferably, as seen in FIG. 4B, which is a schematic representation of a front view of the add-on system of FIG. 4A, the system contains two vessels 51, separate connecting lines, and separate injection pumps for separately storing and delivering cleaning and sterilizing solutions. The plastic cap 53 to the bottle 51 is tightly screwed to the bottle top and the bottle top is vented to prevent vacuum from crushing the solution containers as cleaning or sterilizing solution is withdrawn therefrom. Alternatively, the cap 53 is loosely fitted permitting vacuum break-through air leakage.

The vinyl tube 50 is connected to the suction inlet of an injection mechanism, or in FIG. 4A, a dispensing pump or injection pump 54, which dispensing pump 54 can be any positive displacement pump, such as a gear pump, a syringe pump, a piston pump, an oscillation pump, a peristaltic pump or any kind of pump or positive delivery device capable of delivering a measured amount of cleaning or sterilizing solution. In FIG. 4A, the outlet 55 of said dispensing pump 54 is connected to another delivery tube 56, which delivery tube (or injection line) is either fed directly to the water sump or may optionally be teed into the water supply line, preferably at a location prior to the inlet or suction side of the circulation pump of the water/ice system. When the cleaning solution is fed directly into the water sump, this is done preferably above the level of water held therein so that an air gap prevents water from the ice machine being siphoned or drawn back into the cleaning/sterilizing solutions.

Although the injection mechanisms depicted in the drawings are positive displacement pumps, other mechanisms are possible and are to be included within the meaning of the term "injection mechanism." For example, the storage vessels could be inverted, having a gravity flow to the water/ice system, and the cleaning/sanitizing flow controlled by a check valve, or possibly by the combination of a check valve and a venturi eductor located in the water/ice circulation lines.

The add-on cleaning/sanitizing system may be comfortably held within an apparatus case or container 59 which case 59 itself may have mounting slots 57, as in FIGS. 4A and 4B, for easy mounting internally or externally (see FIG. 1A) on the surfaces of the ice machine. In fact, wall surfaces external to the ice machine structures may be useful for mounting our cleaning/sterilizing system. (See FIG. 1B.) Similarly, the apparatus case may be mobile and brought to and connected with an ice machine equipped to accept the cleaning system contained therein.

Depicted also in FIG. 4A is a control board 58. In FIG. 5, the control board 58 is depicted in further detail. The control board 58 contains a relay 61, an LED light tube 62, a modular female connector 63, a cleaning frequency selector switch, 64, and a momentary pump switch or priming switch 65. Also depicted in FIG. 4A is an electric power cord 67 and an electric line 66 to the dispensing pump 54. Each of these devices may be manually operated or, when connected to the ice machine, may be monitored and operated by the microprocessor and controlling/monitoring system.

The methods and systems described below provide unique and novel solutions in preventing the ingress of organisms, as well as creating an environment within the ice making compartment that is not conducive to the formation (growth) of the organisms.

The present disclosure also provides many additional advantages, which shall become apparent as described below.

SUMMARY

One embodiment for protecting the ice machine is through filtration of the air that is circulated into a food zone that is the ice making portion of the machine. This can be accomplished through one or more of the following:

(1) water spray to remove contaminants/particles entering into the ice machine by means of an air moving device which causes air to pass through a vessel where recirculating water that has been filtered by a microbial control water filter in which the water is sprayed or cascaded across the flow path collecting contaminants. Air would then enter into the food zone of the ice machine and attached bin, creating a net positive flow of purified air into the machine, excluding the opportunity for micro-organisms to enter and contaminate the food zone.

(2) It is also possible to purify the air entering into the ice machine through the use of an anti-microbial pesticide mechanism, such as direct ultraviolet (UV) exposure to the air stream, or ozone or other free radical generation and mixing with the airstream.

Still another embodiment includes a method of sealing the food zone of the ice machine to create a leak-tight air volume, and filling this sealed volume with an inert atmosphere free of any micro-organisms, so that outside contaminants (micro-organisms) are prevented from entering into the machine.

Further objects, features and advantages of the present disclosure will be understood by reference to the following drawings, detailed description and appended claims.

BRIEF DESCRIPTION OF THE DRAWINGS

FIGS. 1A and 1B provide an illustration of a conventional automatic ice making machine with the add-on cleaning/sterilizing system located in two different locations.

DETAILED DESCRIPTION OF THE PREFERRED EMBODIMENT

Figure 2:
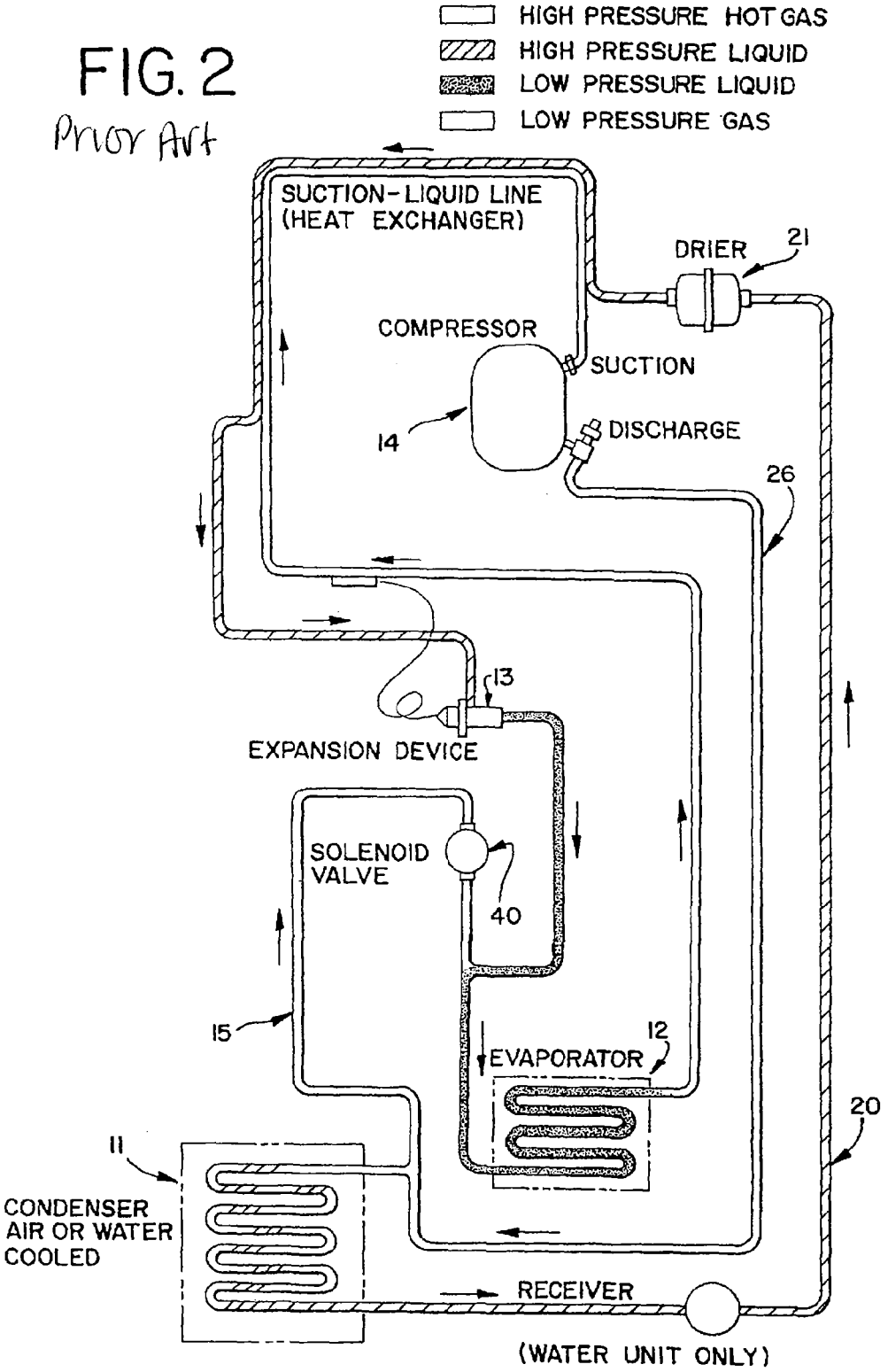
FIG. 2 Prior Art
FIG. 2 provides a line diagram describing an embodiment for the coolant/refrigerant system of the conventional ice machine of FIG. 1.
Figure 3A:
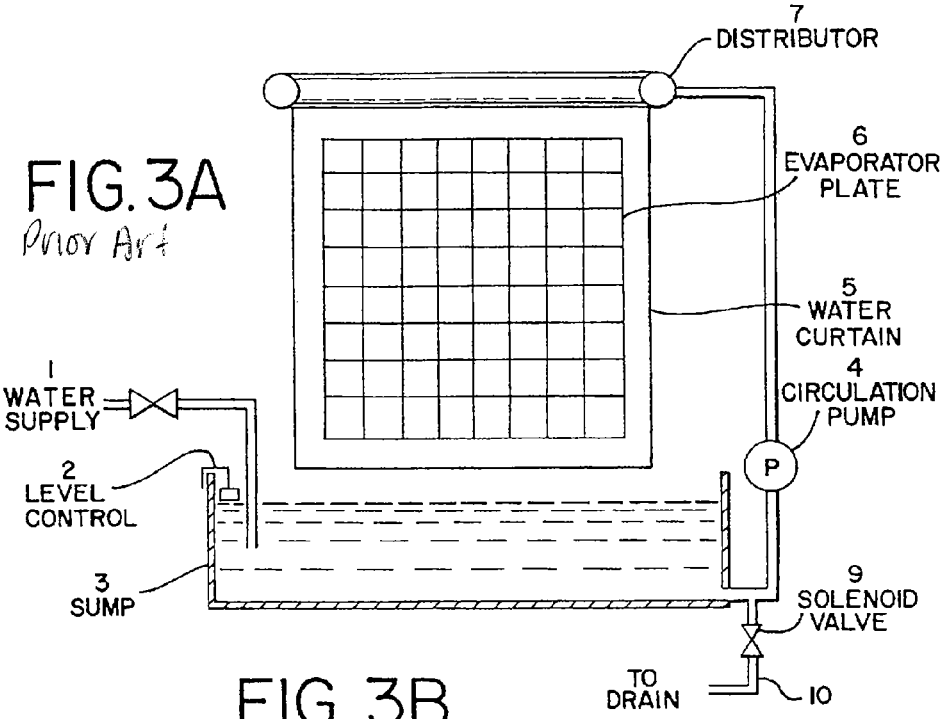
FIG. 3A Prior Art
FIGS. 3A and 3B provide line diagrams and drawings for an embodiment of the water/ice system of the conventional ice machine of FIG. 1.
Figure 3B:
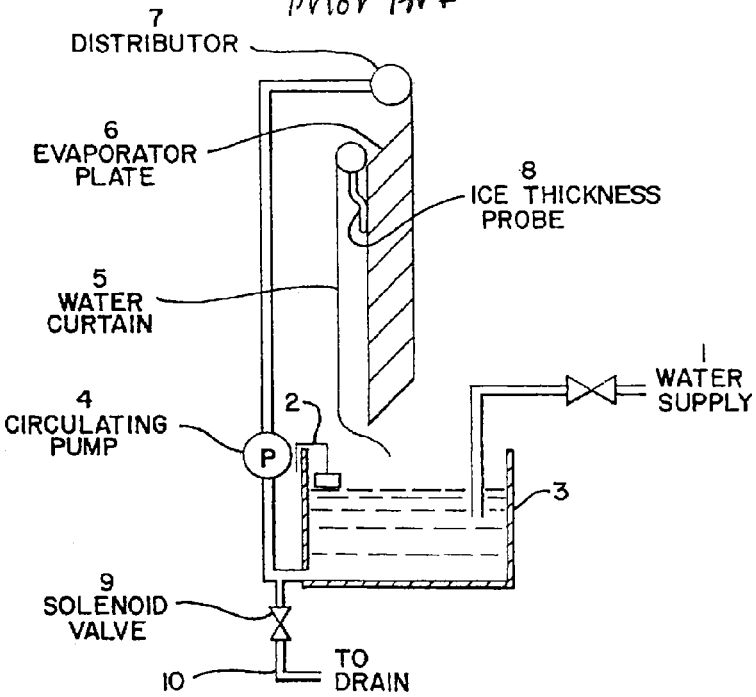
FIG. 3B Prior Art
Figure 4A:
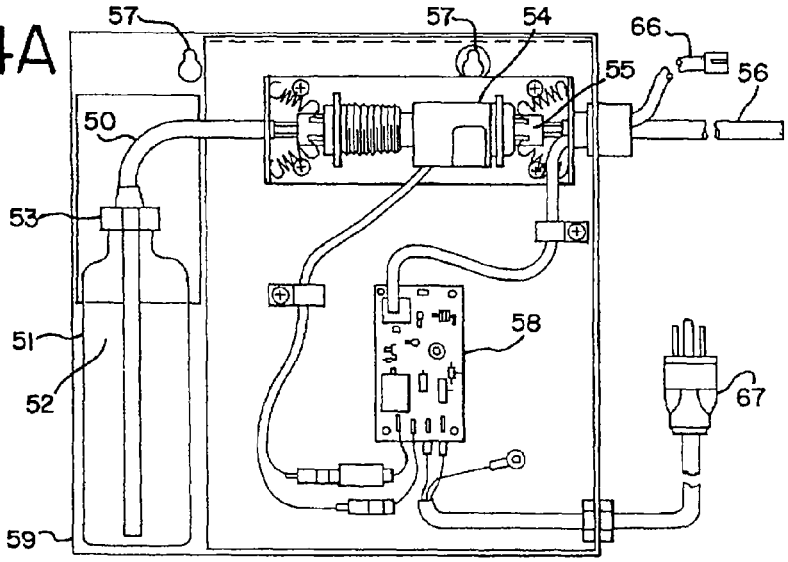
FIG.4A Prior Art
FIGS. 4A and 4B provide respectively an inside view and front view drawing of an embodiment of the cleaning/sterilizing system of the conventional ice machine of FIG. 1A.
Figure 4B:
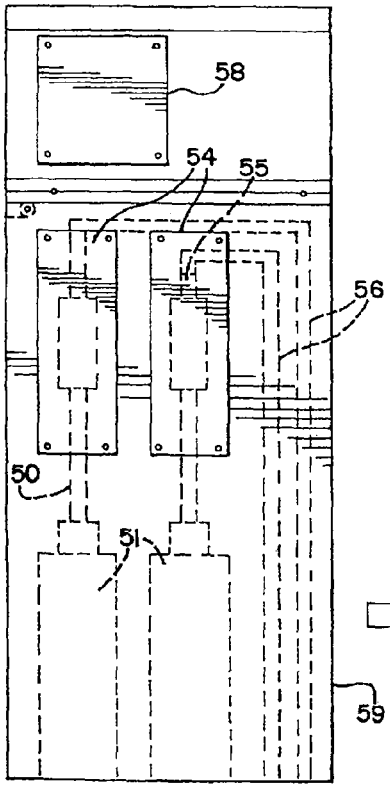
FIG.4B Prior Art
Figure 5:
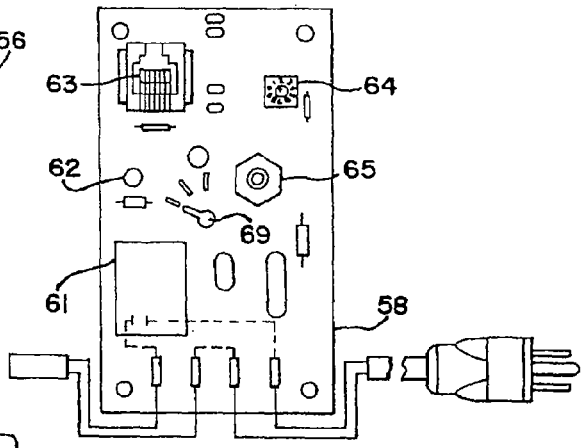
FIG.5 Prior Art
FIG. 5 provides further details for an embodiment for the control panel for the cleaning/sterilizing system of FIG. 4.
Figure 6:
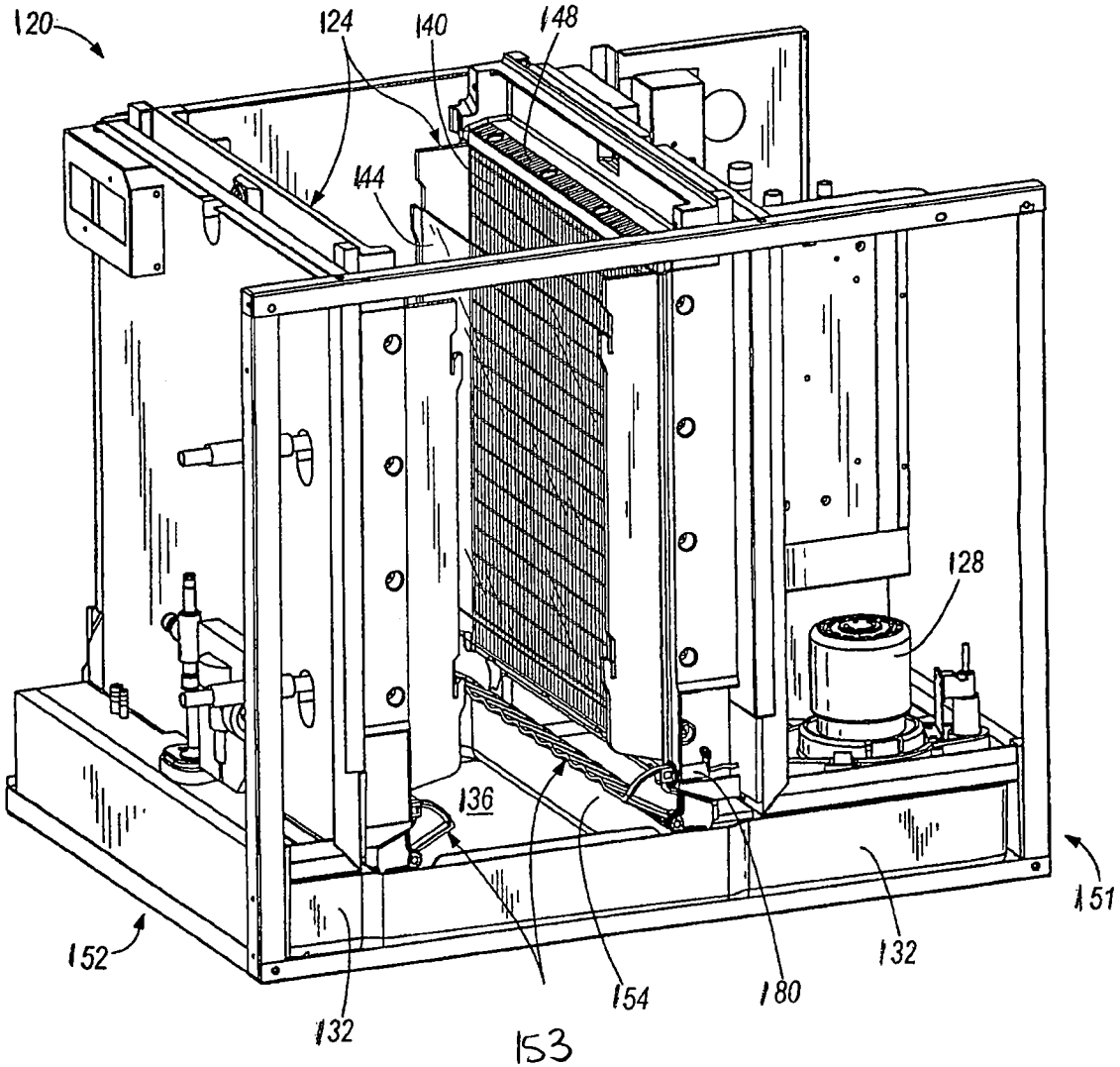
FIG. 6 is a perspective view of an ice making machine which can be adapted to receive any of the filtration and cleaning embodiments according to the present disclosure.

An ice making machine 120 according to FIG. 6, includes a pair of evaporator assemblies 124, a water pump 128, a water sump 132, and an ice chute 136 through which ice pieces are discharged to a bin (not shown) for collection and storage. Although the ice making machine 120 illustrated in FIG. 6 is adapted for forming a geometric grid of cubes connected by a thin bridge layer of ice, it should be noted that the various aspects can be applied to ice machines adapted to produce ice in any other shape formed in unconnected or connected assemblies on any type of ice forming surface (e.g., individual pockets or other receptacles, one or more troughs, a flat or substantially flat ice forming sheet, and the like). With reference again to the embodiment of FIG. 6, each evaporator assembly 124 of the illustrated ice making machine 20 includes an ice-forming surface 140.

Each evaporator assembly 124 has a shield 144 adjacent the ice-forming surface 140. Although not required, the shield 144 can be used to control the discharge of ice from the ice-forming surface 140 during a harvesting cycle of the ice making machine 120. The ice-forming surface 140 and the shield 144 are oriented substantially vertically and are spaced a relatively small distance apart, although it will be appreciated that the ice-forming surface 140 and/or the shield 144 can be oriented in other manners while still performing their respective functions.

A flexible curtain can be attached to the shield 144 and can extend from a bottom portion of the shield. For example, each evaporator assembly 124 in the illustrated embodiment has a flexible curtain attached to the shield 144. The flexible curtain is angled or curved toward the ice-forming surface 140 in an at-rest state, but is pliable and easily deflected outwardly away from the ice-forming surface 140 when contacted by ice pieces. In other embodiments, the flexible curtain can have other shapes also capable of being deflected when contacted by ice falling from the ice-forming surface 140.

An evaporator 148 is connected to each ice-forming surface 140 of the illustrated ice making machine 120 in order to chill the ice-forming surfaces 140. The evaporators 148 are part of a refrigeration system, which circulates a refrigerant through a refrigeration cycle to chill each ice-forming surface 140.

As shown in FIG. 6, the ice chute 136 is positioned between the evaporator assemblies 124 to receive ice pieces therefrom. One evaporator assembly 124 is positioned adjacent the water pump 128 (near a first end 151 of the ice making machine 120), and the other evaporator assembly 124 is substantially remote from the water pump 128 (near a second end 152 of the ice making machine 120). The water sump 132 includes portions adjacent the first and second ends 151 and 152 of the ice making machine 120 to receive water from the adjacent evaporator assemblies 124 as described in further detail below. The water sump 132 extends around both sides of the ice chute 136 such that the portion of the water sump 132 adjacent the second end 152 of the ice making machine 120 is in communication with the portion of the water sump 132 adjacent the first end 151. The water pump 128 is in fluid communication with the water sump 132 at the first end 151 of the ice making machine 120. In other embodiments, water can be received within a water sump 132 having any other shape and size desired, such as a pan located generally beneath one or more evaporator assemblies 124, one or more troughs positioned to receive water from one or more evaporator assemblies 124, and the like.

Unless otherwise noted, the description of the evaporator assembly 124 (and its components) herein applies to both evaporator assemblies 124, which are substantially identical in structure and operation in the illustrated embodiment. Any number of evaporator assemblies 124 can be provided as part of the ice making machine 120, such as one, three, or more evaporator assemblies 124.

As shown in FIG. 6, an ice barrier 153 is positioned at the bottom of the evaporator assembly 124 along a boundary wall 154 separating the water sump 132 and the ice chute 136. The ice barrier 153 of the illustrated embodiment is positioned vertically above the water sump 132 and the ice chute 136, but substantially below the ice-forming surface 140. The ice barrier 153 is rotatably mounted, and is movable about a pivot axis between a first orientation and a second orientation. In some embodiments, the ice barrier 153 is rotatably mounted to the evaporator assembly 124, while in others the ice barrier 153 is also or instead rotatably mounted to other structure of the ice making machine 120.

Switch 180 senses the presence/absence of a magnet, not shown, and controls the operation (e.g., on or off mode) of the ice making machine 120 based at least in part upon the orientation of the ice barrier 153. Generally, the ice making machine 120 is on when the ice barrier 153 is in the first orientation, and is turned off by the switch 180 when the ice barrier 153 is in the second orientation. In some embodiments, the switch 180 includes a Hall-effect sensor to detect the presence or absence of the magnet. The switch 180 in the illustrated embodiment is configured to interrupt the ice-making ability of the ice making machine 120 by stopping the water flow over the ice-forming surface 140 (driven by the water pump 128) and/or by stopping the refrigeration cycle that chills the ice-forming surface 140. For this purpose, the switch 180 may be coupled to a controller (not shown) in communication with the water pump 128 and/or the refrigeration cycle.

The features of FIGS. 7-12 that are similar to FIGS. 1-6 will use the same reference numerals.

Figure 7:
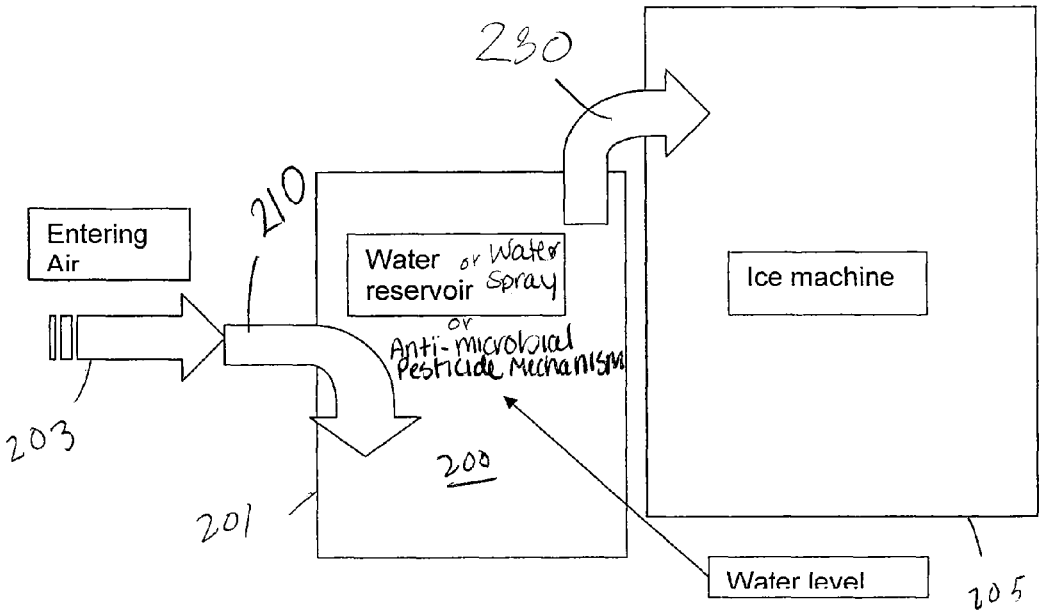
FIG. 7 is a block diagram of air cleaning system according to one embodiment of the present disclosure, wherein air that enters the ice making machine is filtered through the water reservoir, water spray or anti-microbial pesticide mechanism prior to entering the ice making machine.

One embodiment according to the present disclosure is shown in FIG. 7, which pertains to an inlet air filtration. That is, one method of protecting the ice machine is through filtration of air that is convected or communicated into a food zone portion 205 of the ice making machine. Food zone portion 205 includes sump 136, evaporator assembly 124 and a distributor that distributes water to evaporator assembly 124, for example, distributor 7. This can be accomplished through one or more of the following including a water reservoir or water spray or anti-microbial pesticide mechanism 200:

Water spray 200 removes contaminants/particles entering into food zone portion 205 of the ice machine. This is a common practice in other industries to reduce or eliminate contaminants in the air flow. Paint spray booths utilize water spray filtration to contain paint overspray. Water is cascaded across the flow path of the exhaust air and the paint particulates are retained in the water. In an ice machine application air entering into the food zone portion 205 of the ice making machine, as shown by arrows 203 and 210, by means of an air moving device, for example, a fan, would pass through a vessel 201 where recirculating water that has been filtered by a microbial control water filter is sprayed or cascaded across the flow path collecting contaminants. Air would then enter into the food zone portion 205 of the ice machine, as shown by arrow 230, and attached bin, creating a net positive flow of purified air into the machine, excluding the opportunity for micro-organisms to enter and contaminate the food zone.

It is also possible to purify the air entering into the ice machine through the use of an anti-microbial pesticide mechanism 200, such as direct ultraviolet (UV) exposure to the air stream, or ozone or other free radical generation and mixing with the airstream. In an ice machine air entering into the food zone portion 205 of the ice making machine, as shown by arrows 203 and 210, by means of an air moving device, for example, a fan, would pass through a vessel 201 where direct ultraviolet (UV) exposure to the air stream, or ozone or other free radical generation and mixing with the airstream. Air would then enter into the food zone portion 205 of the ice machine, as shown by arrow 230, and attached bin, creating a net positive flow of purified air into the machine, excluding the opportunity for micro-organisms to enter and contaminate the food zone.

Figure 8:
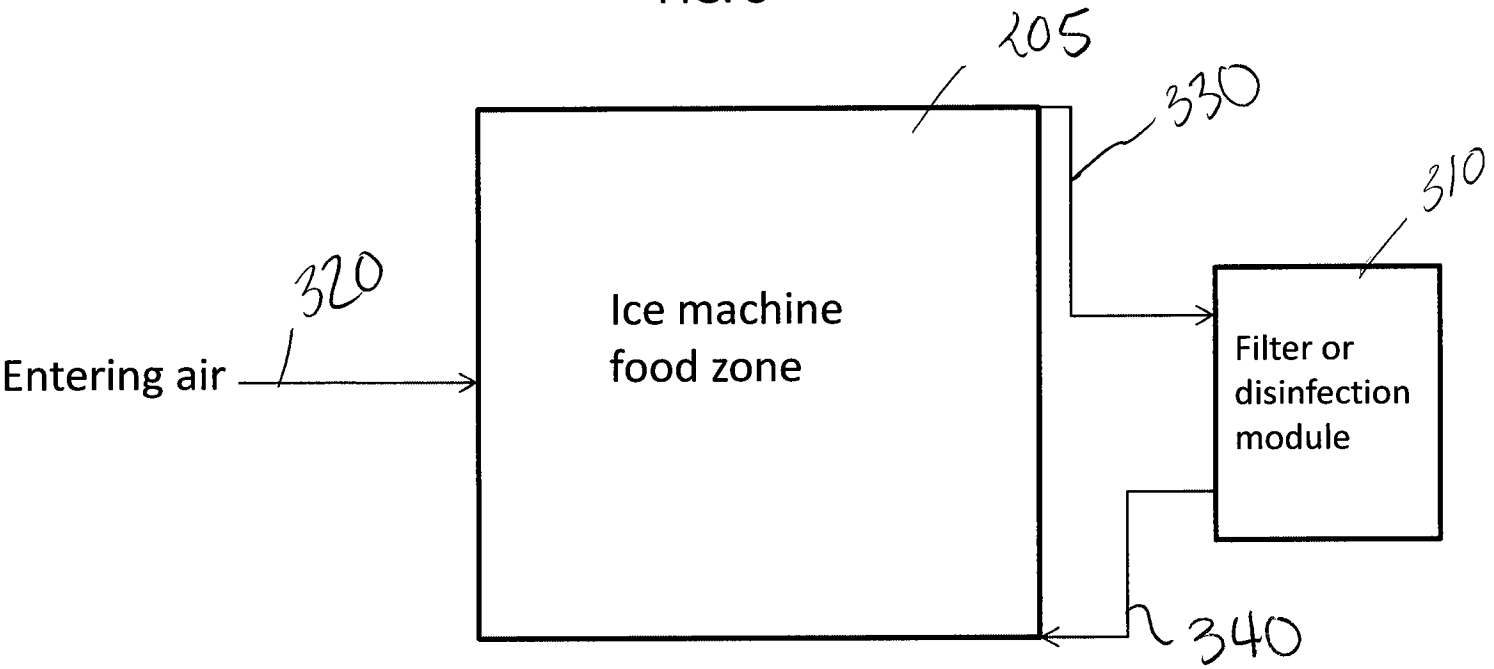
FIG. 8 is a block diagram of air cleaning system according to one embodiment of the present disclosure, wherein air in an ice machine food zone is directed into a filter or disinfection module and directed from the filter or disinfection module into the ice machine food zone.

An alternate method to inlet air filtration shown in FIG. 8 is to employ a filter system or pesticide system 310 of any of the types described in the inlet air filtration method to continuously clean recirculated air contained in the food zone to filter micro-organisms out of the air volume contained within the food zone portion 205 of the ice machine and bin:

Intake of air at one end of the combined food zone via a duct system, as shown by arrow 320.

Circulation of the air through any one of several high efficiency filters, including HEPA or water spray, or through a disinfection module using UV, ozone, or other free radical, as shown by arrow 330.

Discharge of the air into the opposite end of the combined food zone, as shown by arrow 340, ensuring complete turnover of the enclosed air to eliminate all contaminants introduced into the food zone by leakage or door/machine compartment openings.

Figure 9:
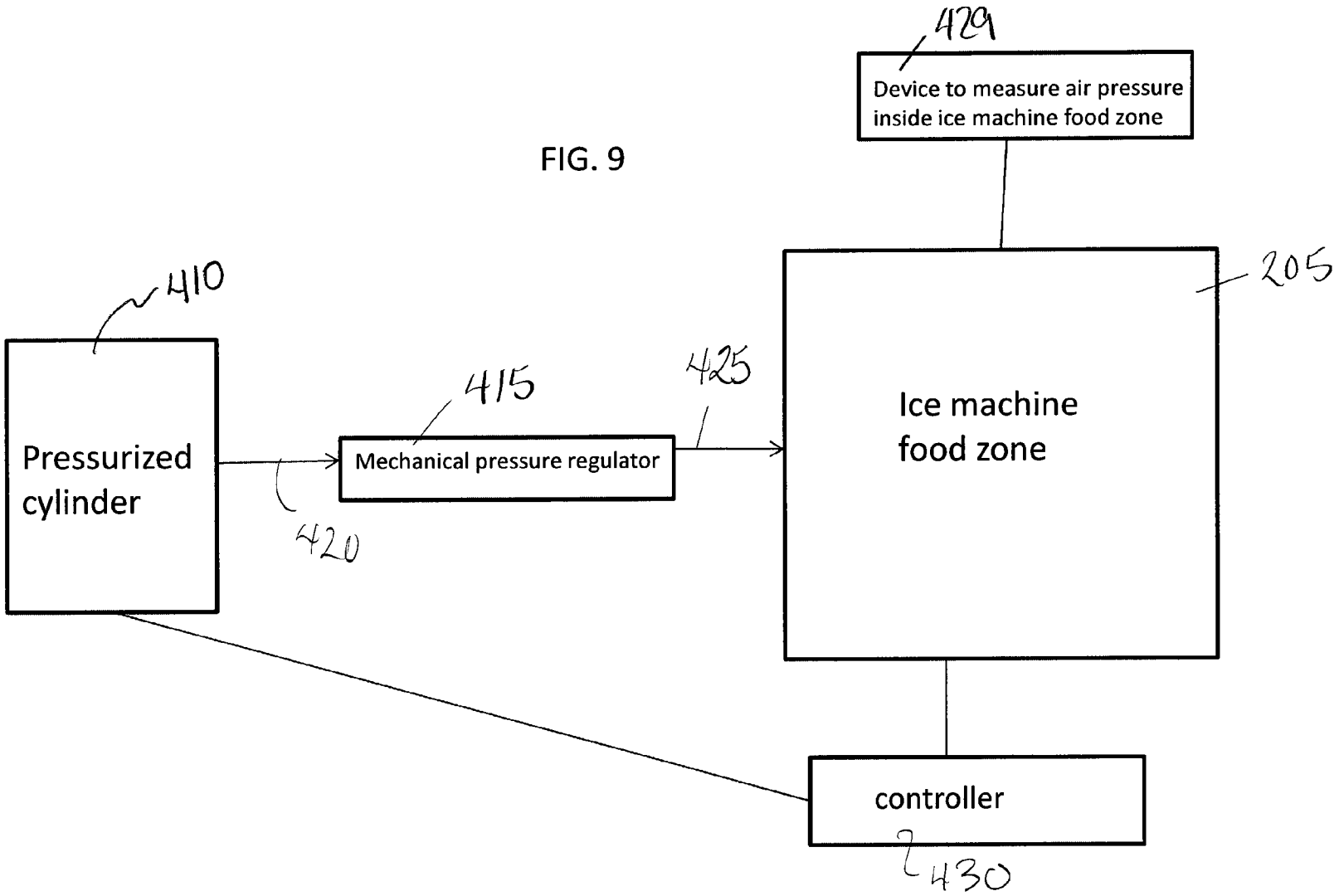
FIG. 9 is a block diagram of air cleaning system according to one embodiment of the present disclosure, wherein gas is metered into an ice machine food zone.

Still another method of cleaning the ice machine according to the present disclosure is by sealing the ice machine by a sealing device that blocks entry of outside air or ambient air into the ice machine and producing a positive internal pressure, so that outside contaminants (micro-organisms)

are prevented from entering into the machine, as shown in FIG. 9. This can be accomplished by:

A system where a pure (free of micro-organisms) and inert gas is metered into the ice machine providing positive air pressure in food zone portion 205 and preventing any infiltration of outside air into the food zone. In this embodiment the inert gas is contained in a pressurized cylinder 410 and is metered into food zone portion 205 using a mechanical pressure regulator 415, as shown by arrows 420, 425. The advantage of this method is that it is non-electrical and will continue to operate during a power loss. With other devices that are dependent on electricity any claims of sanitation protection would only apply while the unit is powered. In the event of a power loss there would be a loss of sanitation protection to the unit. Use of nitrogen as the inert gas has the added advantage of inhibiting the growth of most common micro-organisms, providing additional protection.

An enhancement to this method would be the addition of devices 429 to measure the air pressure inside food zone portion 205 and a control 430 to energize or de-energize the air moving device, for example, a fan, to maintain a specific amount of pressure. This would be a more energy efficient method than continuous operation.

Figure 10:
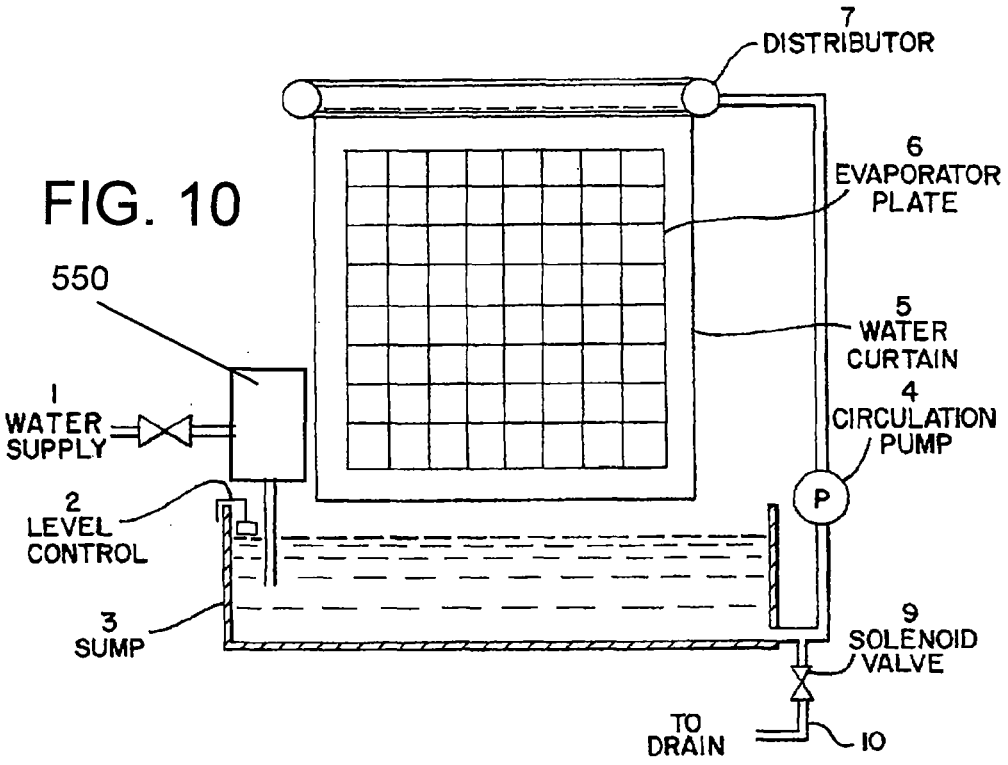
FIG. 10 provides a line diagram and drawing of a water cleaning system according to one embodiment of the present disclosure, wherein micro-biological control is connected to an inlet of a water supply.

Another path for the introduction of micro-organism is through the water entering the ice machine. Municipal water supplies provide safe water for consumption, but are not completely free of micro-organisms. By integrating a microbiological control 550 into the inlet water supply 1, as shown in FIG. 10, which can consist of membrane filtration, or treatment with UV light, silver ions, anti-microbials, or ozone, the foodzone for the ice machine can be maintained as a sterile environment.

These methods combined with an automatic cleaning system for the ice machine that removes scale build-up would eliminate the necessity of opening the machine for sanitizing and cleaning due to water-borne contaminants.

Figure 11:
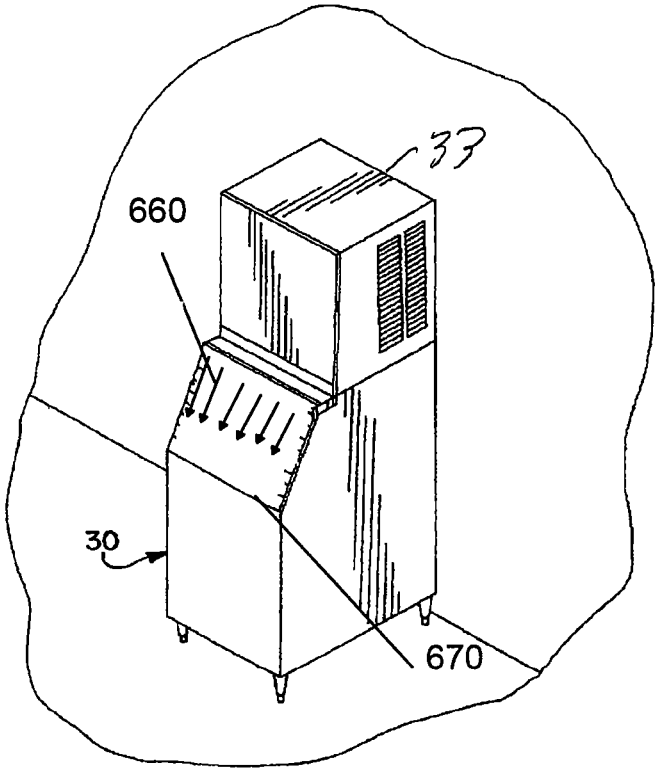
FIG. 11 provides an illustration of an automatic ice making machine having an air cleaning system according to one embodiment of the present disclosure, wherein air is flowed across an opening of the storage bin to form an air curtain.

Another path for microbials to enter into the ice machine is through the storage bin door 31, shown in FIGS. 1A and B. Referring to FIG. 11 where storage bin door 31 has been removed for clarity, to remove ice from the storage bin 30 a hinged bin door 31 is opened and the ice is manually scooped from the bin. When bin door 31 is opened air is brought into the storage bin which is in contact with the ice machine 33. Air from bin 30 circulates up into ice machine 33.

Incorporating an air curtain, as shown by arrows 660, into ice storage bin 30 the ingress of outside air into the storage bin 30 can be controlled. When bin door 31 is opened air inside storage bin 30 is flowed, for example, by a fan, at a high velocity across the opening of storage bin 30. This air flow acts as a curtain to prevent air from entering. When bin door 31 is closed the power to the air flow device, not shown, is de-energized. This method coupled with the continuously circulated/purified air described above will provide the desired protection to ice machine 33.

Optionally, combining the air curtain with the use of an anti-microbial bin or bin liner 670 further enhances or ensures cleanliness by preventing or significantly inhibiting contaminant growth in the food zone.

Furthermore, combining the air curtain and anti-microbial bin or bin liner with the use of scoops also made of anti-microbial material further preserves the cleanliness of the bin area.

Figure 12:
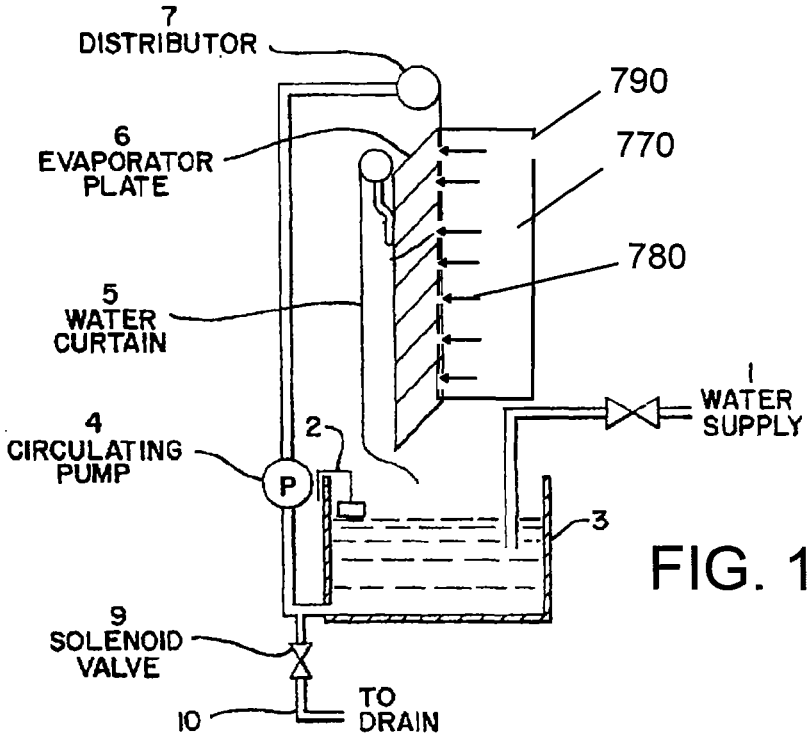
FIG. 12 provides a line diagram and drawing of air cleaning system according to one embodiment of the present disclosure, wherein an air pump pumps air into an interface of ice and an evaporator to provide pressure into the interface.

Referring to FIG. 12, another area for contamination which requires cleaning according to the present disclosure is during harvest cycle, when the ice making device in order to release ice from the evaporator surface of evaporator plate 6 uses a number of methods to assist in the harvesting of ice. Typically hot gas in the refrigeration system is passed through the evaporator plate 6 to melt the interface between the ice and the evaporator surface. To speed the harvest of the ice often mechanical means are employed. These can consist of electrical solenoids that actuate a metal pin into the interface providing slight pressure to the ice and causing it to release quicker. Another method is through the use of an air pump 770 to pump air into the interface, as shown by arrows 780, which provides pressure into the interface of the ice and evaporator plate 6. Typically the air pump 770 gets its air external of the ice making evaporator compartment (food zone).

To provide clean air to the air pump 770, an air inlet 790 to the air pump 770 would be in the food zone of the ice machine where the air is treated through one of the means described herein. For example, the air is treated by a water reservoir or water spray or anti-microbial pesticide mechanism, membrane filtration, or treatment with UV light, silver ions, anti-microbials, or ozone.

If an inert gas is used to positively pressurize the food zone, this inert gas, for example, from pressurized cylinder 410, can be used to replace the pressurized air supplied by the air assist pump.

While we have shown and described several embodiments in accordance with our invention, it is to be clearly understood that the same may be susceptible to numerous changes apparent to one skilled in the art. Therefore, we do not wish to be limited to the details shown and described but intend to show all changes and modifications that come within the scope of the appended claims.

What is claimed is:

1. An ice maker comprising:

(1) an ice making compartment having therein:

an evaporator;

a sump which holds water;

a distributor;

a pump that directs said water from said sump to said distributor and then to said evaporator whereupon ice pieces form; and a chute through which said ice pieces are discharged from said ice making compartment;

an air moving device communicating with an anti-microbial filter disposed in or about said ice making compartment to substantially remove microbials from air prior to said air entering said ice making compartment, wherein said air moving device creates a net positive air flow of purified air from said anti-microbial filter into said ice making compartment, wherein said anti-microbial filter is at least one selected from the group consisting of: a water spray, an anti-microbial pesticide mechanism, a water reservoir, and ozone, and (2) an ice bin disposed below said ice making compartment for receiving ice via said chute.

2. The ice maker of claim 1, wherein said anti-microbial filter is said water spray.

3. The ice maker of claim 2, wherein said air moving device directs said air through a vessel where filter water has been filtered by a microbial control water filter and is sprayed or cascaded across a flow path of said air to form said water spray.

4. The ice maker of claim 3, wherein said air flows from said vessel to said ice making compartment creating said net positive air flow of purified air.

5. The ice maker of claim 1, wherein said anti-microbial filter is said anti-microbial pesticide mechanism.

6. The ice maker of claim 5, wherein said anti-microbial pesticide mechanism filters using a mechanism selected from the group consisting of ultraviolet air stream, ozone, free radical generation, and any combination thereof.

7. The ice maker of claim 1, wherein said anti-microbial filter is said water reservoir.

8. The ice maker of claim 1, wherein said air is communicated to said anti-microbial filter prior to being communicated to said ice making compartment.

9. The ice maker of claim 1, wherein said air in said ice making compartment is communicated to said anti-microbial filter to be circulated through said filter and discharged from said filter to be returned into said ice making compartment.

10. An ice maker comprising:

an ice bin; and an ice making compartment which comprises:

an evaporator;

a sump which holds water;

a distributor;

a pump that directs said water from said sump to said distributor and then to said evaporator;

a pressurized cylinder metering an inert atmosphere of purified air into said ice making compartment that fills said ice making compartment with the purified air and creates a net positive flow of purified air into said ice making compartment so that outside contaminants do not enter said ice making compartment; and a sealing device that seals a volume of the ice making compartment with the purified air and blocks ambient air from entering said ice making compartment, wherein said purified air is free of micro-organisms.

11. The ice maker of claim 10, further comprising:

a mechanical pressure regulator operably connected to said pressurized cylinder, wherein said mechanical pressure regulator meters said purified air and creates said positive air pressure.

12. The ice maker of claim 10, further comprising a measurement device that measures an air pressure in said ice making compartment and a controller to energize or de-energize an air moving device to maintain an amount of pressure in said ice making compartment.

* * * * *